United States Patent [19]

Jenkins

[11] Patent Number: 4,915,880

[45] Date of Patent: Apr. 10, 1990

[54] CONTAINER FOR A BUBBLER

[75] Inventor: Glen D. Jenkins, Rockford, Ill.

[73] Assignee: Advanced Delivery & Chemical Systems Incorporated, Austin, Tex.

[21] Appl. No.: 354,789

[22] Filed: May 22, 1989

[51] Int. Cl.[4] ..... B01F 3/04

[52] U.S. Cl. ..... 261/124; 220/66; 220/70; 215/1 R; 215/1 C

[58] Field of Search ..... 261/124; 220/66, 70; 215/1 R, 1 C

[56] References Cited

U.S. PATENT DOCUMENTS

| | | | |
|---|---|---|---|
| 1,680,616 | 8/1928 | Horst | 215/1 R |
| 2,424,583 | 7/1947 | Rahm | 215/1 C |
| 2,587,237 | 2/1952 | Sinaiko | 220/70 |
| 3,298,553 | 1/1967 | Busher | 215/1 R |
| 3,416,703 | 12/1968 | Chmielowiec | 215/1 R |
| 3,966,077 | 6/1976 | Jardine | 220/70 |
| 4,298,037 | 11/1981 | Schumacher et al. | 261/124 |
| 4,350,259 | 9/1982 | Cartossi | 220/66 |
| 4,388,996 | 6/1983 | Panicci | 220/70 |
| 4,467,929 | 8/1984 | Jakobsen et al. | 215/1 C |

*Primary Examiner*—Tim Miles

*Attorney, Agent, or Firm*—Leydig, Voit & Mayer

[57] ABSTRACT

A bubbler assembly includes a quartz container formed with an indented bottom which defines a concave pocket to impart strength to the container. The pocket is filled with a heat conductive epoxy in order to improve the heat transfer characteristics of the bottom of the container.

8 Claims, 1 Drawing Sheet

CONTAINER FOR A BUBBLER

BACKGROUND OF THE INVENTION

This invention relates generally to a bubbler assembly of the type having a container for holding a liquid chemical whose vapors are bubbled upwardly out of the container for delivery to a manufacturing process or the like. Usually, the bubbler assembly is placed on a temperature controlling device which heats or cools the liquid chemical through the bottom of the container.

More specifically, the invention relates to a bubbler assembly in which the container is made of a highly refractory material such as fused quartz. Such containers are conventionally made either with a flat bottom or with an indented bottom having a concave pocket in its lower side. A container with a flat bottom possesses good heat transfer characteristics but lacks high strength. By indenting the bottom, the strength of the container is increased but heat transfer capability is sacrificed.

SUMMARY OF THE INVENTION

The general aim of the present invention is to provide a bubbler assembly having a new and improved container which possesses both good strength charactertistics and good heat transfer characteristics.

A more detailed object of the invention is to achieve the foregoing by providing a container having an indented bottom, which inherently possesses high strength characteristics, and by filling the pocket in the bottom with a heat conductive material to improve the heat transfer characteristics of the container.

The invention also resides in the use of a metal-containing epoxy to fill the pocket and to enable the heat transfer characteristics of the container to be improved in a relatively quick and inexpensive manner.

These and other objects and advantages of the invention will become more apparent from the following detailed description when taken in conjunction with the accompanying drawings.

DETAILED DESCRIPTION OF THE PREFERRED EMBODIMENT

Figure 1:
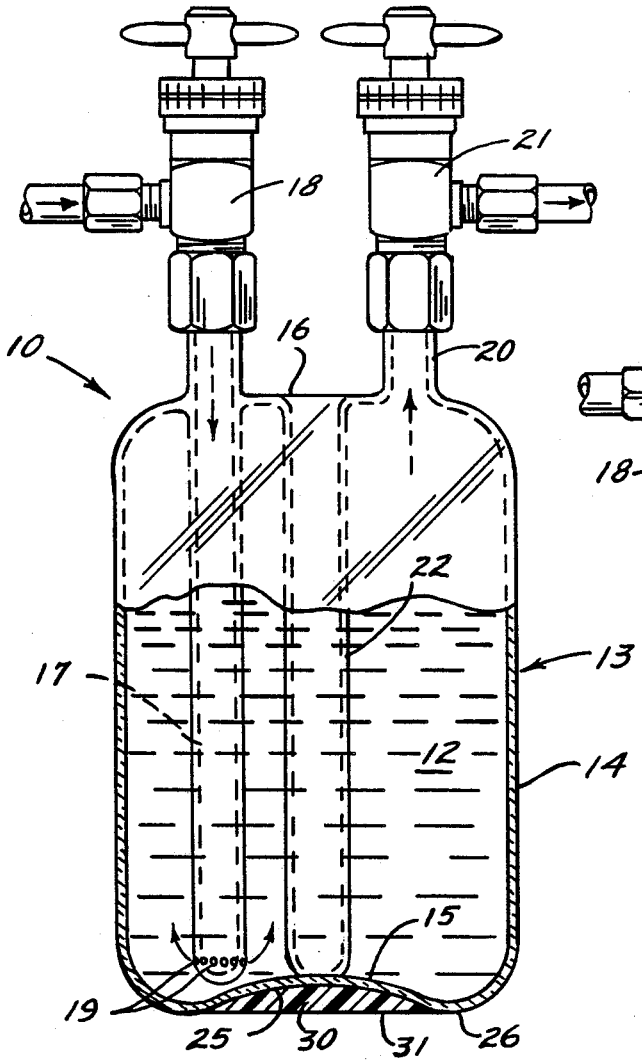
FIG. 1 is a side elevational view of a new and improved bubbler assembly incorporating the unique features of the present invention, certain parts of the assembly being broken away and shown in section.
Figure 2:
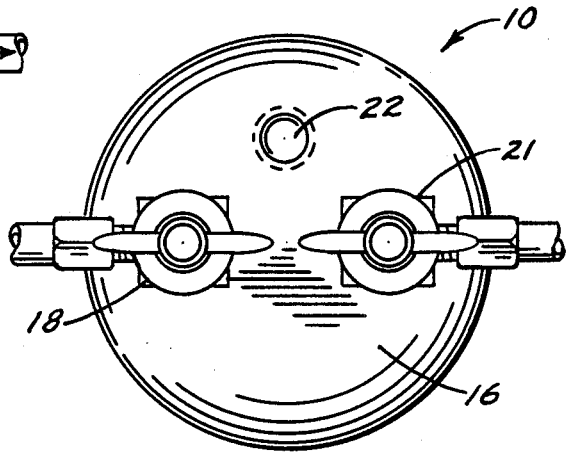
FIG. 2 is a top plan view of the bubbler assembly.

For purposes of illustration, the invention has been shown in the drawings as being embodied in a bubbler assembly 10 for directing a carrier gas through a liquid chemical 12 and for delivering the carrier gas and the vapor picked up from the chemical to a manufacturing process. A bubbler assembly of this type is widely used in the semiconductor industry.

More particularly, the bubbler assembly 10 includes an upright container 13 made of a highly refractory material such as fused quartz. The container is formed with a cylindrical side wall 14, a circular bottom 15 and a circular top 16.

A carrier gas delivery tube 17 is located in the container 13 with its lower end immersed in the liquid chemical 12 and positioned near the bottom 15 of the container. The upper end of the tube projects upwardly from the container and is connected to a valved fitting 18 for admitting a pressurized carrier gas (e.g., argon or nitrogen) into the tube. Such gas discharges out of radially extending ports 19 in the lower end portion of the tube 17, flows upwardly within the liquid chemical 12 to pick up vapors therefrom, and then bubbles upwardly out of the container along with the entrained vapor. The carrier gas and vapor flow upwardly into an outlet tube 20 which projects upwardly from the container 13 and then are discharged from the container by way of a valved fitting 21. In lieu of using the carrier gas, a vacuum pump may be connected to the fitting 21 to draw vapor from the container, the fitting 18 being closed when a vacuum pump is employed.

Conventionally, the bubbler assembly 10 is used in conjunction with a temperature controller (not shown) which physically resembles a hot plate but which may be used either to heat or cool the container 13 through the bottom 15 thereof and thereby promote the release of vapor from the liquid chemical 12. A tubular thermal well 22 is formed in the container and is adapted to receive a thermocouple or other temperature sensing probe (not shown) for transmitting to the controller a signal which is representative of the temperature of the liquid chemical.

In order to impart strength to the container 13, the lower side of the bottom 15 is indented and is formed with a concave pocket 25 (FIGS. 1 and 3) which is circular in shape. As a result of the pocket, the peripheral margin of the bottom is formed by an annulus 26 whose extreme lower portion is disposed in a horizontal plane. It is well known that an indented bottom improves the strength characteristics of the container.

In accordance with the present invention, the pocket 25 in the bottom 15 of the container 13 is filled with a heat conductive material 30 which improves the heat transfer characteristics of the container. As a result of the filler 30, the container possesses good strength by virtue of being formed with the indented bottom and yet possesses substantially the same good heat transfer capability as a flat bottom container.

In this particular instance, the filler 30 is a two-part epoxy which contains aluminum in order to impart heat conductivity to the filler. A suitable epoxy is that designated as 568B by Aremco Products of Ossining, New York.

Figure 3:
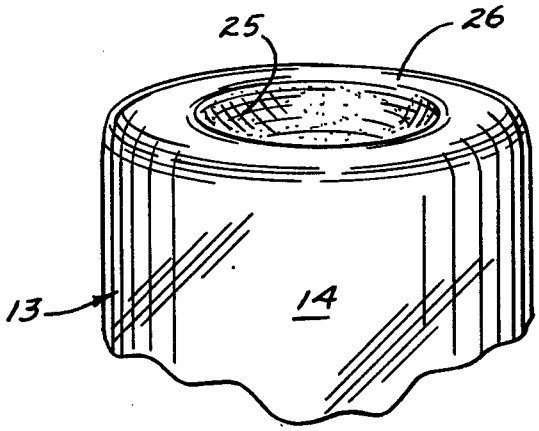
FIG. 3 is a perspective view showing the bottom portion of the container of the bubbler assembly prior to filling of the pocket.

To apply the filler 30, the pocket 25 is roughened as shown in FIG. 3 through the use of sandpaper or the like. The epoxy then is mixed and is potted in the pocket. After the epoxy dries, it is ground smooth so as to leave a flat lower surface 31 disposed in the same plane as the lower end portion of the annulus 26. Thus, the lower end of the annulus 26 and the lower side 31 of the filler 30 are flush with one another so as to make the bottom surface of the bubbler assembly 10 flat both for the purpose of stability and for the purpose of good heat transfer.

From the foregoing, it will be apparent that the present invention brings to the art a new and improved bubbler assembly 10 in which the bottom 15 of the container 13 is indented for strength and yet, at the same time, is solid and flat in order to effect good heat transfer. Thus, the container has substantially the same heat transfer characteristics as a flat bottom container but has the strength characteristics inherent in an indented container.

I claim:

1. A bubbler assembly comprising an upright container made of a highly refractory material, said container including a bottom having a lower side formed with an indented concave pocket for providing strength to the container, and a filler potted within said pocket and bonded to the material of said container, said filler being heat conductive and enhancing the heat transfer charactertistics of the bottom of said container.

2. A bubbler assembly as defined in claim 1 in which said container is made of fused quartz, said filler being an expoxy bonded to said quartz.

3. A bubbler assembly as defined in claim 1 in which said filler includes a lower side disposed in a substantially horizontal plane, the lower side of the bottom of said container having an annulus extending around said pocket, said annulus having a lower end portion terminating in said plane.

4. A bubbler assembly as defined in claim 2 in which said filler includes a lower side disposed in a substantially horizontal plane, the lower side of the bottom of said container having an annulus extending around said pocket, said annulus having a lower end portion terminating in said plane.

5. A bubbler assembly as defined in claim 2 in which said epoxy contains metal.

6. A bubbler assembly for use with a carrier gas to cause the carrier gas to pick up and deliver the vapor of a liquid chemical, said bubbler assembly comprising an upright container made of high purity fused quartz and having a closed bottom whereby liquid chemical may be placed in said container, the lower side of the bottom of said container being formed with an indented concave pocket, an upright tube located within said container and having an upper end portion adapted for connection to a source of carrier gas, said tube having a lower discharge end portion immersed in the liquid chemical to deliver the carrier gas into the liquid chemical whereby the carrier gas passes through the liquid chemical and picks up vapors therefrom, and said container having an outlet for discharging the carrier gas and vapors bubbling upwardly from said liquid chemical, said bubbler assembly being characterized in that said concave pocket is substantially filled with epoxy bonded to said quartz to enhance the heat transfer characteristics of the bottom of said container.

7. A bubbler assembly as defined in claim 6 in which the lower side of the bottom of said container includes an annulus extending around said pocket, said annulus having a lower end portion terminating in a substantially horizontal plane, said epoxy having a lower surface located in said plane and substantially flush with the lower end portion of said annulus.

8. A bubbler assembly as defined in claim 6 in which said epoxy contains metal.

* * * * *